US008393396B2

(12) United States Patent
O'Brien et al.

(10) Patent No.: US 8,393,396 B2
(45) Date of Patent: Mar. 12, 2013

(54) SUBTERRANEAN VALVE OPERATED BY STRING RELATIVE MOVEMENT

(75) Inventors: Robert S. O'Brien, Katy, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 251 days.

(21) Appl. No.: 12/501,421

(22) Filed: Jul. 11, 2009

(65) Prior Publication Data

US 2011/0005763 A1 Jan. 13, 2011

(51) Int. Cl.
*E21B 34/00* (2006.01)
*E21B 43/00* (2006.01)
*E21B 34/12* (2006.01)

(52) U.S. Cl. ..... 166/334.2; 166/332.2; 166/330

(58) Field of Classification Search ..... 166/334.2, 166/332.2, 330; 251/251, 257, 258, 259
See application file for complete search history.

(56) References Cited

U.S. PATENT DOCUMENTS

| | | | | |
|---|---|---|---|---|
| 3,697,043 | A | | 10/1972 | Baker |
| 3,741,249 | A | | 6/1973 | Leutwyler |
| 3,827,494 | A | | 8/1974 | Crowe |
| 4,130,166 | A | | 12/1978 | Akkerman et al. |
| 4,197,879 | A | | 4/1980 | Young |
| 4,210,207 | A | * | 7/1980 | McStravick et al. ..... 166/330 |
| 4,293,038 | A | | 10/1981 | Evans |
| 4,332,267 | A | | 6/1982 | Evans |
| 4,368,871 | A | | 1/1983 | Young |
| 4,406,328 | A | | 9/1983 | Brooks |
| 4,415,037 | A | | 11/1983 | Brooks |
| 4,421,171 | A | | 12/1983 | Haynes et al. |
| 4,449,587 | A | | 5/1984 | Rodenberger et al. |
| 4,458,751 | A | * | 7/1984 | Haynes ..... 166/133 |
| 4,475,598 | A | | 10/1984 | Brakhaage, Jr. et al. |
| 4,522,370 | A | | 6/1985 | Noack et al. |
| 4,569,397 | A | | 2/1986 | Brakhage, Jr. et al. |
| 4,700,782 | A | * | 10/1987 | Read ..... 166/330 |
| 4,967,844 | A | | 11/1990 | Brooks et al. |
| 5,050,839 | A | | 9/1991 | Dickson et al. |
| 6,109,352 | A | | 8/2000 | Edwards et al. |
| 2008/0110632 | A1 | | 5/2008 | Beall |
| 2011/0088906 | A1 | | 4/2011 | Myerley |

* cited by examiner

*Primary Examiner* — Cathleen Hutchins
(74) *Attorney, Agent, or Firm* — Steve Rosenblatt

(57) ABSTRACT

A valve is mounted to a tubular string and has an actuation assembly that is isolated from well fluids. The valve member can be a ball that rotates on a pivot and is actuated by relative rotation of string components that straddle the ball. Rotation of one string component is linked to the closure ball by an external slanted slot with an operating ball that rides in it and connects the rotating string component to the closure ball. Travel stops limit the desired rotation of the closure ball in opposed directions. The closure ball can alternatively be rotated by relative longitudinal string component movement that is converted to relative rotation such as through the use of a j-slot mechanism. Internal seals isolate the slanted slot and operating ball from well fluids.

17 Claims, 4 Drawing Sheets

SUBTERRANEAN VALVE OPERATED BY STRING RELATIVE MOVEMENT

FIELD OF THE INVENTION

The field of this invention is string mounted valves and more particularly valves that can be operated by string manipulation.

BACKGROUND OF THE INVENTION

Tubing strings used downhole typically maintain isolation between the surface and a producing region or isolate producing regions from each other. In some applications these valves can be used as safety valve. There are several types employed with some of the more popular being a rotating 90 degree ball with a passage therethrough or a pivoting valve member known as a flapper that is moved away from a mating seat with a hollow tube known as a flow tube. The flow tube is operated from the surface using control lines that transmit hydraulic pressure from the surface to an operating piston in the valve housing that is in turn connected to the flow tube. In the case of the 90 degree ball valves, the ball turns on a pivot and is surrounded by a cage-like structure that is actuated from the surface through control lines that engage a piston or pistons for cage movement in opposed directions. One such control system for a 90 degree ball is shown in US Publication 20080110632. One issue with this design is that the cage system that rotates the ball is exposed to well fluids and can get caked up to an extent that may interfere with its future operation. The cage generally has to be precision fabricated and assembled and its reliance on actuating pistons greatly increases the overall housing length of the tool.

In the past ball valves have been used as lubricator valves. They generally featured a pair of control lines to opposed sides of a piston whose movement back and forth registered with a ball to rotate it 90 between an open and a closed position. Collets could be used to hold the ball in both positions and would release in response to control pressure in one of the control lines. An example of such a design can be seen in U.S. Pat. Nos. 4,368,871; 4,197,879 and 4,130,166. In these patents, the ball turns on its own axis on trunnions. Other designs translate the ball while rotating it 90 degrees between and open and a closed position. One example of this is the 15K Enhanced Landing String Assembly offered by the Expro Group that includes such a lubricator valve. Other designs combine rotation and translation of the ball with a separate locking sleeve that is hydraulically driven to lock the ball turning and shifting sleeve in a ball closed position as shown in U.S. Pat. No. 4,522,370. Some valves are of a tubing retrievable style such as Halliburton's PES® LV4 Lubricator Valve. Lock open sleeves that go through a ball have been proposed in U.S. Pat. No. 4,449,587. Other designs, such as U.S. Pat. No. 6,109,352 used in subsea trees have a rack and pinion drive for a ball and use a remotely operated vehicle (ROV) to power the valve between open and closed positions claiming that either end positioned is a locked position but going on to state that the same ROV simply reverses direction and the valve can reverse direction.

What is needed and not provided in the known prior art is a way to operate a downhole valve in a manner that simplifies the actuation design and preferably isolates it from the surrounding well fluid. In the preferred embodiment portions of the string are secured to each other for relative movement so that when such movement occurs the valve moves in a first direction and when such movement is reversed the valve moves in the opposite direction. This can be accomplished by relative rotation between string components that are held together. In one embodiment the relative string rotation is translated through a slanted slot and ball combination to deliver a turning moment to the valve member as the ball in the slot travels along the slot. The same result can be obtained using a j-slot mechanism between string components that induces relative rotation between string components that are otherwise held together as in the first example where the relative rotation directly induces valve member movement as opposed to indirectly such as using a j-slot device or equivalent to induce valve member movement. In the preferred embodiment the valve member is a ball with a passage through it but other forms of valve members are contemplated. Those skilled in the art will more readily appreciate the invention from a review of the description of the preferred embodiment and the associated drawings while understanding that the full scope of the invention is to be determined by the appended claims.

SUMMARY OF THE INVENTION

A valve is mounted to a tubular string and has an actuation assembly that is isolated from well fluids. The valve member can be a ball that rotates on a pivot and is actuated by relative rotation of string components that straddle the ball. Rotation of one string component is linked to the closure ball by an external slanted slot with an operating ball that rides in it and connects the rotating string component to the closure ball. Travel stops limit the desired rotation of the closure ball in opposed directions. The closure ball can alternatively be rotated by relative longitudinal string component movement that is converted to relative rotation such as through the use of a j-slot mechanism. Internal seals isolate the slanted slot and operating ball from well fluids.

DETAILED DESCRIPTION OF THE PREFERRED EMBODIMENT

Figure 1:
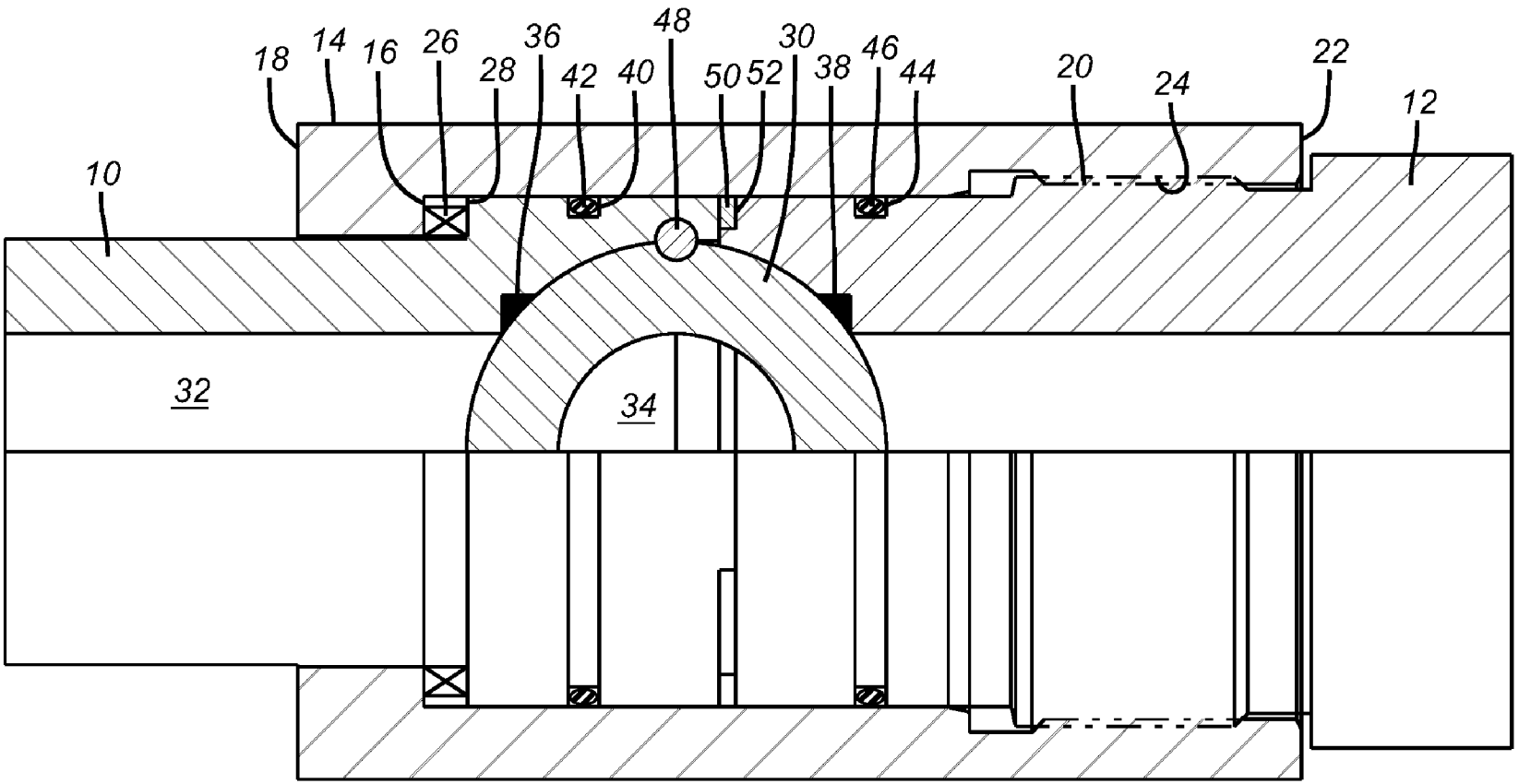
FIG. 1 is a section view of a ball type valve of the present invention shown in the closed position.

FIG. 1 illustrates upper string component 10 and lower string component 12 that form part of a tubular string downhole that is omitted for clarity. A coupling 14 has a shoulder 16 at one end 18 and a thread 20 near end 22 to engage thread 24 on component 12. A bearing 26 is disposed between shoulder 16 on coupling 14 and shoulder 28 on component 10. Threads 20 and 24 are made up to secure the bearing 26 so that it can transmit thrust loads without damage while permitting relative rotation between components 10 and 12.

A closure ball 30 sits between components 10 and 12 while extending into through passage 32 that runs the length of components 10 and 12. Closure ball 30 has a passage 34 therethrough that is shown in FIG. 1 oriented at 90 degrees to passage 32 to represent the closed position of the closure ball 30. Seals 36 and 38 are respectively mounted preferably to components 10 and 12 although one or both can alternatively be mounted to the closure ball 30.

Groove 40 contains a seal 42 to seal component 10 to the coupling 14. Groove 44 contains seal 46 to seal component 12 to the coupling 14. Closure ball 30 pivots on opposed pivot locations 48, only one of which is shown in the part section of FIG. 1. The other pivot location is 180 degrees opposed. While the pivots 48 are shown in component 10 they can alternatively be in component 12 as long as the mechanism that rotates the ball that will be discussed below is mounted to another component from where the pivots 48 are located.

A travel stop can be used in the design that limits the movement of components 10 and 12 with respect to each other to a distance that represents the preferred amount of rotation of the closure ball 30. This is accomplished by the interaction of a tab 50 on component 10 with the end of a groove 52 on component 12. Those skilled in the art will appreciate that the tab and groove locations can be reversed as between components 10 and 12 to get the same result. Other travel stops designs are also contemplated.

Figure 2:
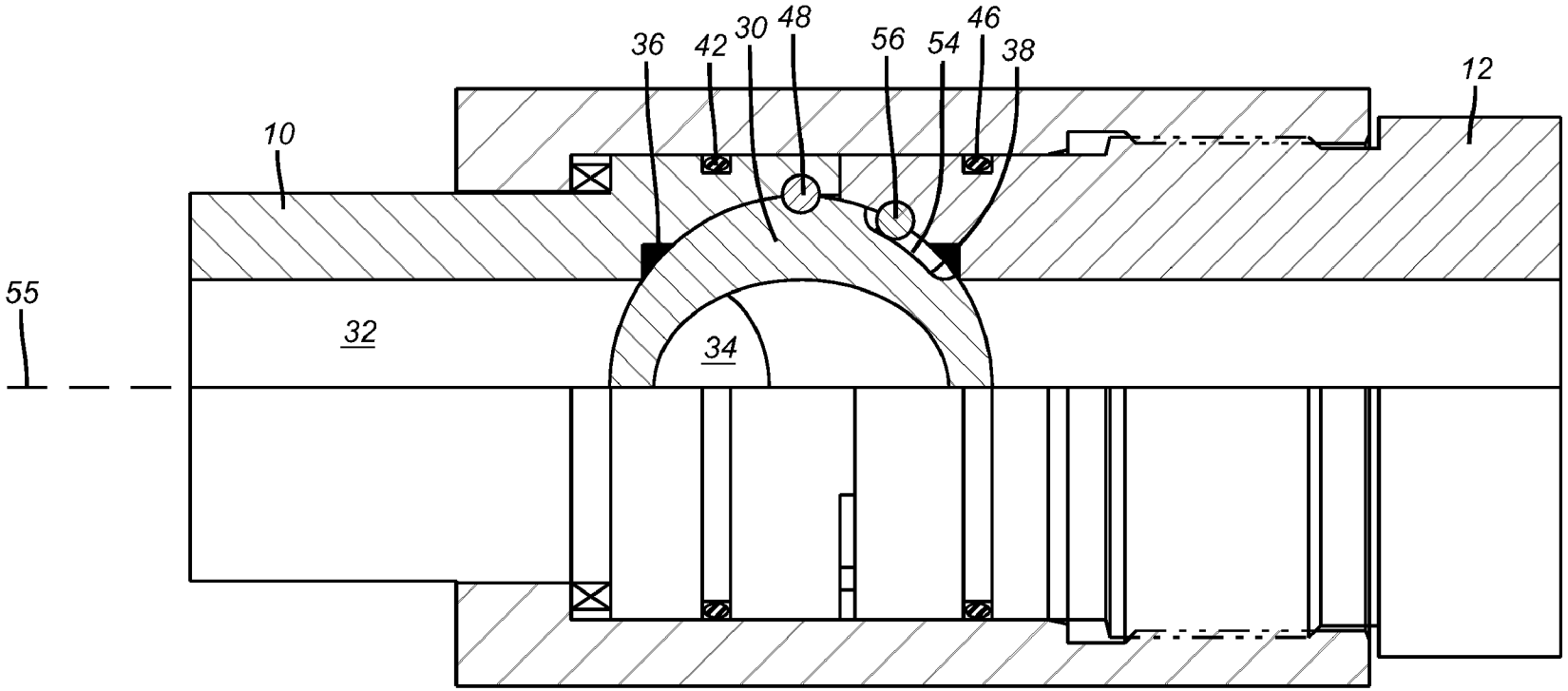
FIG. 2 is the view of FIG. 1 with the closure ball in the half closed position to show the drive system for the closure ball.
Figure 3:
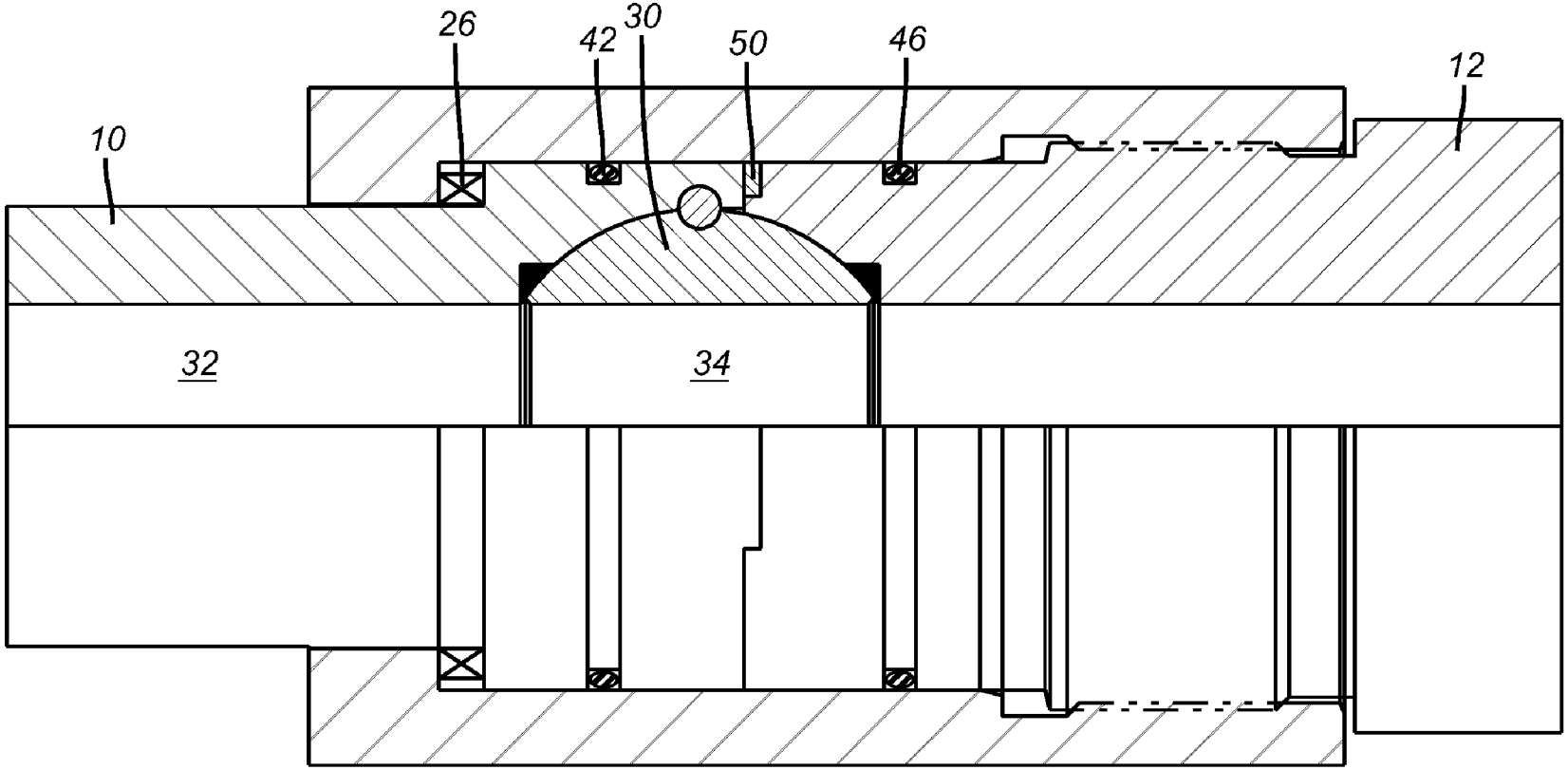
FIG. 3 is the view of FIG. 2 with the closure ball in the fully closed position.
Figure 4:
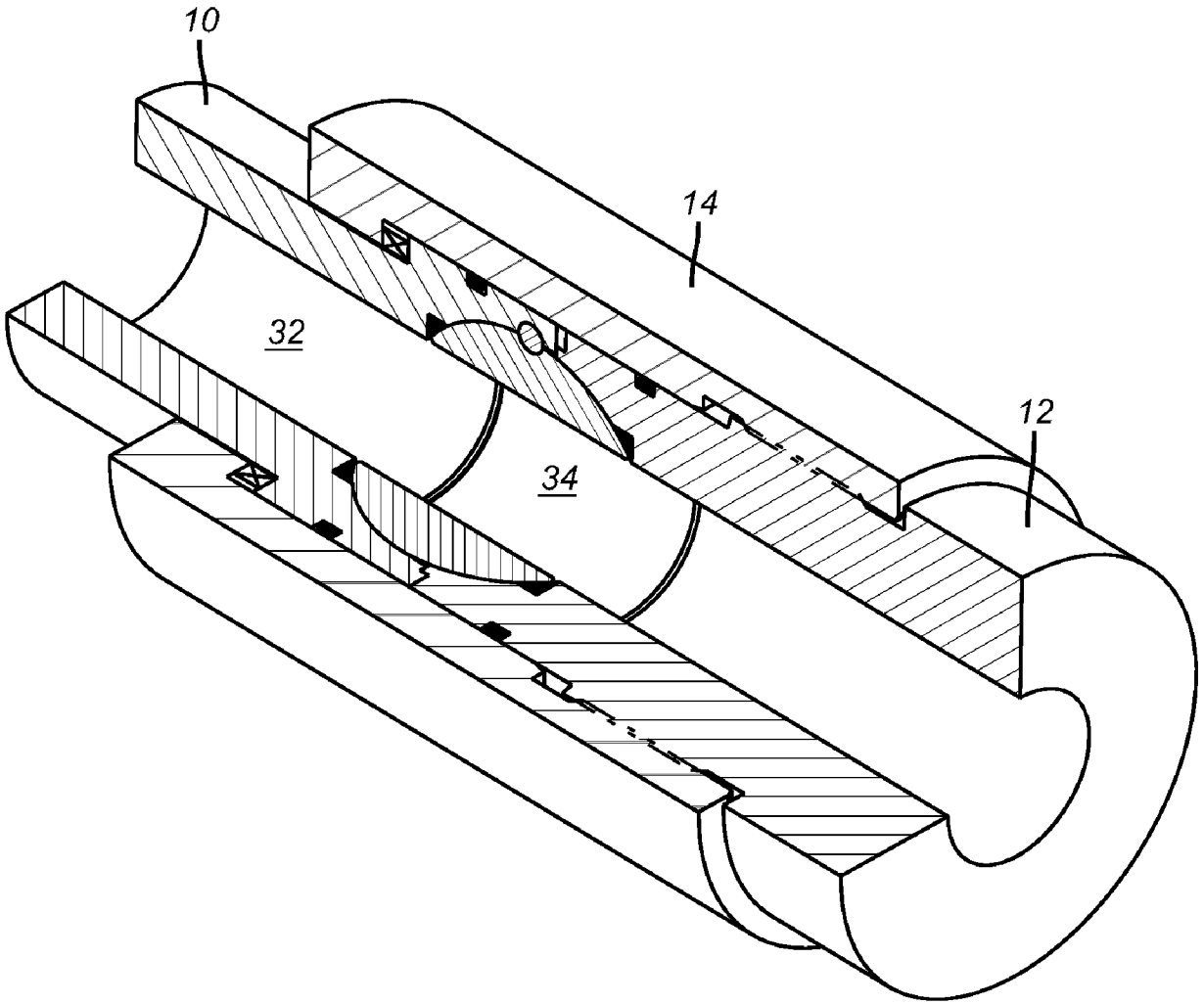
FIG. 4 is an isometric view of the view of FIG. 3 showing the closure ball in the fully open position.

Referring now to FIG. 2, one mechanism that is contemplated for rotation of the ball 30 is illustrated. When the component 10 is rotated from the surface, the opposed pivots 48 transfer that rotational input to the ball 30. Component 12 is stationary but is linked to ball 30 through a slanted slot 54 and an associated operating ball 56. Operating ball 56 can be nothing more than a stationary extending tab in component 12 that rides in slot 54. Slot 54 is slanted with respect to the axis of rotation 55 of component 10. Operating ball 56 is supported to rotate only about its own center, or not at all, with respect to stationary component 12. However, at the same time because operating ball 56 can only turn on its center, or not at all, and extends into slot 54, the closure ball 30 is forced to track the groove 54 that is disposed on its outer surface. As the rotational input is delivered to component 10 and through pivots 48 to closure ball 30, closure ball 30 is forced to rotate about pivots 48 as dictated by the slope of slot 54 with ball 56 extending into it and constrained to only turn on its own center. Eventually another travel stop is reached and the passage 34 in the closure ball 30 aligns with passage 32 in the components 10 and 12 and the valve is in the open position shown in FIG. 3. In FIG. 3 as well as in FIG. 1 the assembly that induces the rotation of the closure ball 30 will show the ball 56 closer to opposed ends of the slot 54. For clarity, the ball 56 and slot 54 are shown only in FIG. 2. Those skilled in the art will appreciate that the locations of the pivots 48 on the one hand and the ball 56 and slot 54 on the other hand can have their respective locations reversed as between components 10 and 12 and the same operations will take place. It will also be appreciated that reversing the rotation of the movable component, such as 10, for example, will reverse the direction of rotation of the closure ball 30 for example. FIG. 4 shows a perspective view in section of the open position of FIG. 3 where the passage 34 in the closure ball 30 is aligned with the passage 34 in the components 10 and 12.

Those skilled in the art will also appreciate that apart from the embodiment employing pure relative rotation between components 10 and 12 to turn the ball 30, the same result can be obtained with reciprocation for example of the component 10. In that example a j-slot relation can exist between the coupling 14 and the component 12. Component 10 would be reconfigured to be directly connected to coupling 14 with a lost motion feature while threads 20 and 24 would be eliminated. This allows component 10 to be biased against ball 30 to hold seal 36 against it while allowing a reciprocating motion to be transferred to coupling 14 so as to induce a turning moment to component 12 so as to allow the combination of the slot 54 and ball 56 to be used to induce closure ball 30 to turn in the manner previously described.

Referring to FIG. 2 those skilled in the art will notice that seals 36 and 38 keep well fluids away from operating ball 56 in slot 54. At the same time, seals 42 and 46 keep well fluids that are outside the string components 10 and 12 away from the operating ball 56 in slot 54 as well. While one assembly of ball 56 in a slanted slot 54 is shown in the drawings, multiple spaced assemblies are contemplated to share the load of turning the ball 30 in opposed directions.

The above description is illustrative of the preferred embodiment and many modifications may be made by those skilled in the art without departing from the invention whose scope is to be determined from the literal and equivalent scope of the claims below.

We claim:

1. A valve assembly for subterranean use, comprising:

relatively movable housing components having a flow passage therethrough for connection to a tubular string;

a rotatable valve member pivoting on a support extending from a first of said components, wherein rotation of said first component operates said valve member, and said support located on a first side of said rotatable valve member, said first component being tubular and having an inner conforming surface to said rotatable valve member, said support located in said conforming surface and said conforming surface surrounds said rotatable valve member said support out of contact with a second of said components that is located on the opposite side of said rotatable valve member from said first component without overlapping said first component, said second component further comprising an associated operator for said rotatable valve member actuated by said relative housing movement for transmitting a force to said valve member at a spaced location from said support for movement between an open and a closed position with respect to said flow passage.

2. The assembly of claim 1, wherein:

said relative movement of said housing components comprises rotation.

3. The assembly of claim 2, wherein:

said valve member comprises a closure ball with a flow passage therethrough;

said associated operator engages an exterior surface of said ball for rotation of said ball.

4. The assembly of claim 3, wherein:

said closure ball rotates on said support further comprises supports mounted in an opposed relation to each other on one of said components;

said associated operator is mounted to a different one of said components than said opposed supports.

5. The assembly of claim 4, wherein:

said opposed supports rotate in tandem with one of said components.

6. The assembly of claim 3, wherein:

said associated operator comprises at least one tab that extends from one of said components into at least one slot in the exterior of said closure ball.

7. The assembly of claim 6, wherein:

said at least one tab comprises an operating ball.

8. The assembly of claim 7, wherein:

said operating ball can turn on the center of said ball.

9. The assembly of claim 6, wherein:

said tab and said slot are isolated from fluids in said passage.

10. The assembly of claim 9, wherein:

said tab and said slot are isolated from fluid outside said housings.

11. The assembly of claim 10, wherein:

said tab and slot are isolated from fluid in said passage by seals between said components and said closure ball.

12. The assembly of claim 11, wherein:

said components are secured to each other with a coupling which retains a bearing and further comprises seals between said coupling and said components for isolation of said tab and slot from fluids exterior to said coupling.

13. The assembly of claim 12, wherein:

said tab comprises an operating ball that can turn on the center of said operating ball.

14. The assembly of claim 1, wherein:

said relative movement of said housing components is axial.

15. The assembly of claim 14, wherein:

said axial relative movement is converted to relative rotational movement.

16. The assembly of claim 1, wherein:

said associated operator is isolated from well fluids in said passage.

17. The assembly of claim 16, wherein:

said associated operator is isolated from well fluids located outside said passage in said housing components.

* * * * *